US010595556B2

(12) United States Patent
Cepiński et al.

(10) Patent No.: US 10,595,556 B2
(45) Date of Patent: Mar. 24, 2020

(54) METHOD AND APPARATUS FOR FILLING TRANSPORT CONTAINERS WITH ROD-LIKE ARTICLES OF TOBACCO INDUSTRY

(71) Applicant: International Tobacco Machinery Poland Sp. z o. o., Radom (PL)

(72) Inventors: Piotr Cepiński, Radom (PL); Radoslaw Owczarek, Radom (PL)

(73) Assignee: International Tobacco Machinery Poland Sp. z o. o., Radom (PL)

( * ) Notice: Subject to any disclaimer, the term of this patent is extended or adjusted under 35 U.S.C. 154(b) by 0 days.

(21) Appl. No.: 16/170,408

(22) Filed: Oct. 25, 2018

(65) Prior Publication Data

US 2019/0116869 A1 Apr. 25, 2019

(30) Foreign Application Priority Data

Oct. 25, 2017 (EP) ..... 17198381

(51) Int. Cl.
*A24C 5/34* (2006.01)
*A24C 5/32* (2006.01)
*A24C 5/354* (2006.01)

(52) U.S. Cl.
CPC ..... *A24C 5/3412* (2013.01); *A24C 5/328* (2013.01); *A24C 5/354* (2013.01)

(58) Field of Classification Search
CPC ..... A24C 5/354; A24C 5/328; A24C 5/3412
USPC ..... 131/282
See application file for complete search history.

(56) References Cited

U.S. PATENT DOCUMENTS

| | | | |
|---|---|---|---|
| 3,267,641 | A | 8/1966 | Molins |
| 5,223,915 | A | 6/1993 | Neri |
| 6,531,693 | B1 | 3/2003 | Focke et al. |
| 7,115,857 | B1 | 10/2006 | Berke |
| 2006/0262293 | A1 | 11/2006 | Sacher et al. |
| 2013/0284188 | A1 | 10/2013 | Owczarek et al. |

FOREIGN PATENT DOCUMENTS

| | | | |
|---|---|---|---|
| CN | 104537671 | A | 4/2015 |
| EP | 1207106 | A1 | 5/2002 |
| EP | 2384652 | A2 | 11/2011 |

(Continued)

OTHER PUBLICATIONS

Extended European search report in European application 17198381.0, dated May 9, 2018.

*Primary Examiner* — Michael H. Wilson
*Assistant Examiner* — Dionne W. Mayes
(74) *Attorney, Agent, or Firm* — Oppedahl Patent Law Firm LLC

(57) ABSTRACT

The object of the invention is an apparatus for filling transport containers (1) with rod-like articles of the tobacco industry, provided with an area (2) receiving the rod-like articles in the form of a mass flow, a rod-like article storage area (3) comprising at least two sidewalls, a filling unit (4) constituting the bottom wall of the storage area for transferring the rod-like articles from the storage area to the transport container, a lowering conveyor (5) working together with the filling unit (4), adapted to lower the transport container while filling with the rod-like articles. The apparatus is characterised by being further provided with a counting module (6) designed to count the rod-like articles in the transport containers, adapted so that the individual rod-like articles being in the transport container are counted.

11 Claims, 8 Drawing Sheets

(56) References Cited

FOREIGN PATENT DOCUMENTS

| | | | |
|---|---|---|---|
| EP | 2384652 | A3 | 1/2012 |
| EP | 2649890 | A1 | 10/2013 |
| EP | 3067823 | A1 | 9/2016 |
| GB | 1055181 | A | 1/1967 |
| JP | H07308181 | A | 11/1995 |
| JP | 2002526048 | A | 8/2002 |
| JP | 2003153679 | A | 5/2003 |
| JP | 2013545476 | A | 12/2013 |
| JP | 2016535888 | A | 11/2016 |
| RU | 2527412 | C2 | 8/2014 |
| WO | 0019844 | A1 | 4/2000 |
| WO | 2012074422 | A1 | 6/2012 |
| WO | 2013055248 | A1 | 4/2013 |
| WO | 2016022085 | A2 | 2/2016 |

METHOD AND APPARATUS FOR FILLING TRANSPORT CONTAINERS WITH ROD-LIKE ARTICLES OF TOBACCO INDUSTRY

The object of the invention is a method and an apparatus for filling the transport containers with rod-like articles of the tobacco industry, in particular an apparatus provided with a rod-like article counting module.

The object of the invention is used in the tobacco industry in the rod-like article transport systems using transport containers.

It is a standard practice in current systems for the production of cigarettes, multi-segment filters or other rod-like articles manufactured in the tobacco industry that ready filter rods and other semi-finished rod-like articles are ordered by the manufacturers from external suppliers. The articles ordered in that way are delivered to the cigarette manufacturer in containers, usually in trays or cardboard boxes with the capacity of 500 to 8000 rods in one container depending on the type of articles. In the case of such type of delivery of the rod-like articles a problem in determining the exact number of articles being in a container appeared.

The rod-like article counting systems known so far were based on counting each article during a single-layer flow on a belt or a drum before entering a hopper and filling a container. Such solutions never give a hundred percent guarantee that all articles which have been counted will get to the container. There is a risk that during packing the flow of articles may be disturbed or the articles may jam or fall off the conveyor, as a result of which the quantity counted before filling does not correspond to the actual quantity of articles being in the container. It is also possible that defective rod-like articles, for example damaged during the flow, get into the hopper before filling the container. Then the rejection of such defective articles before placing in the container will result in a discrepancy between what the sensor counted and the actual number of articles in the container.

A disadvantage of such counting systems is that they do not give the actual number of rod-like articles placed into the containers.

Methods of determining the number of rod-like articles of the tobacco industry are known in the prior art, however, these are systems determining the number of rod-like articles placed in final packaging, e.g. cigarettes in a pack intended for the final consumer. The counting of rod-like articles in packs is typically performed with an accuracy of about 5% with the typical constant number of 20 articles in a pack with the surface of about 15 $cm^2$. The accuracy of measurement at 5% means that the system is capable of correctly detecting the lack of an individual article in a pack.

The document EP2649890 discloses an apparatus for checking the number of filter-tipped cigarettes in a pack based on an image showing the end surfaces of filters of all cigarettes arranged parallel in the pack. The number of cigarettes in a pack is usually 20 pieces. The identification of an individual cigarette is based on detecting the outlines of front surfaces in the recorded image, and on this basis the number of cigarettes in a pack is determined. The apparatus additionally has a module checking the correctness of identification of individual cigarettes, checking whether an individual cigarette has not been identified as two cigarettes.

The document US20060262293 discloses a method for checking the filling of containers filled with rod-like articles of the tobacco industry. According to this method, at least one property of the container contents is detected and at least one property, in particular the predetermined desired container contents, is compared. In addition, when the deviation from the desired contents is greater than the predetermined tolerance value, a signal identifying an incorrect filling is generated. The container filling level is detected by a laser sensor situated above the products, and the container contents are measured by the height of the articles in the container. The height may vary depending on the container width. The rod-like articles arranged obliquely in the topmost layer of articles in the container are also detected. The disclosed apparatus uses also one or multiple camera(s) recording the container image in order to assess the correctness of container filling. A single line image sensor working together with a moving container in order to create an image of the articles in the container was also disclosed.

The document U.S. Pat. No. 7,115,857 discloses an apparatus designed to count individual objects based on images of the objects recorded by a camera. Each of such images is recorded using a different single source of light positioned at different angles to the observed surface of the objects. It allows a correct identification of shadows created by objects situated at a different distance from the camera.

The document WO2016022085 discloses an apparatus counting the layers of sheets in a pile using an optical single line sensor situated parallel to the objects being counted. The sensor may move along the pile height generating a one-dimensional signal corresponding to the number of sheet layers in the pile.

The document U.S. Pat. No. 6,531,693 discloses an apparatus and a method of checking whether the cigarette batches are complete and whether the cigarettes are sufficiently filled. Despite careful production, when the cigarettes are manufactured and the cigarette batches are filled with cigarette packages using high-performance machines, it is possible that some cigarette packages are manufactured with cigarettes or contain cigarettes which are not sufficiently filled with tobacco. The disclosed apparatus ensures an improved, contactless method of checking cigarette batches or individual cigarettes. According to this method, the CCD camera or CCD line scanning microscope signal intensity is measured at the ends of the cigarettes or in the space among them. The disclosed method allows checking whether the cigarette batches are complete and whether the cigarettes are sufficiently filled by high-performance machines, such as belt or drum conveyors.

An unsolved problem occurring in the prior art is to determine the number of rod-like articles being in the transport container, in this case the number of rod-like articles in the container is variable between 500 and 8000 pieces. In the prior art, an estimated number of rod-like articles being in the container is determined on the basis of the container dimensions and the product geometry. The accuracy of such estimation is within the scope of approx. 5%. Such a low accuracy of the estimation is a result of the non-uniform distribution of the last layers of rod-like articles being placed and the formation of free spaces resulting from the container filling process dynamics.

The term of transport container is understood as single-chamber or multi-segment cassette used in the tobacco industry, or cardboard boxes which may have various dimensions depending on the kind of product being packed.

Known solutions of the problem in determining the number of articles in a container assume the determination of the weight of filled tray and are not sufficiently accurate in view of a small weight of an individual rod-like article.

The object of the invention is an apparatus for filling the transport containers with rod-like articles of the tobacco industry, provided with an area receiving the rod-like articles in the form of a mass flow, a rod-like article storage area comprising at least two sidewalls, a filling unit constituting a bottom wall of the storage area for transferring the rod-like articles from the storage area to the transport container, a lowering conveyor working together with the filling unit, adapted to lower the transport container while filling with the rod-like articles. The apparatus according to the invention is characterised by being further provided with a counting module designed to count the rod-like articles in the transport containers, adapted so that individual rod-like articles located in the transport container are counted.

The apparatus according to the invention is further characterised in that the counting module comprises a sensor designed to receive an image of rod-like articles in the transport container, such sensor being situated in the filling apparatus in the transport path of transport containers filled with the rod-like articles, below the filling unit, and a counting system designed to count the rod-like articles in the transport container based on the image from the sensor.

The apparatus according to the invention is characterised in that the transport path comprises in particular the filling unit area, the lowering conveyor, a conveyor receiving the filled transport containers filled with the rod-like articles, a conveyor lifting the filled transport containers.

The apparatus according to the invention is characterised in that the sensor is permanently mounted on the structure of the apparatus, and the container with the rod-like articles during the measurement remains immovable in front of the sensor.

The apparatus according to the invention is characterised in that the sensor is permanently mounted on the structure of the apparatus, while the container with the rod-like articles during the measurement moves in front of the sensor.

The apparatus according to the invention is characterised in that the sensor is mounted movably relative to the structure of the apparatus, while the container with the rod-like articles during the measurement remains immovable in front of the sensor.

The apparatus according to the invention is characterised in that the sensor is mounted movably relative to the structure of the apparatus, and, in addition, the container with the rod-like articles during the measurement moves in front of the sensor.

The apparatus according to the invention is characterised by having a unit adjusting the level of container filling with the rod-like articles based on the number of rod-like articles determined by the counting module.

The apparatus according to the invention is characterised in that the control unit is adapted to generate a signal classifying the transport containers as correctly filled containers and incorrectly filled containers based on the number of rod-like articles determined by the counting module.

The apparatus according to the invention is characterised by being further provided with a conveyor receiving the transport containers classified by the control unit as correctly filled containers and a conveyor receiving the transport containers classified by the control unit as incorrectly filled containers.

The apparatus according to the invention is characterised in that the module counting the rod-like articles comprises a sensor selected from a group comprising electromagnetic radiation sensors, including infrared sensors, sensors working in the visible light range, and sensors working in the ultraviolet light or x-ray radiation range which create the image of individual rod-like articles in the transport container, and the counting system determines the number of rod-like articles by analysing the image coming from the sensor.

Moreover, the object of the invention is a method of container filling with rod-like articles of the tobacco industry comprising steps wherein: empty containers are delivered to a filling apparatus, by means of the filling unit the rod-like articles are fed from a storage area into a container, the container is moved during the container filling process, the filled container is received. The method according to the invention is characterised in that before receiving the filled container, by means of the counting module the individual rod-like articles located in the container are counted.

The method according to the invention is further characterised in that the number of rod-like articles counted by the counting module is compared with an expected number of rod-like articles and a control signal depending on the comparison result is generated.

The method according to the invention is further characterised in that the level of container filling with the rod-like articles is adjusted based on the number of the rod-like articles determined by the counting module.

The method according to the invention is further characterised in that by means of the control unit the filled transport container is classified as incorrectly filled if the counted number of rod-like articles differs from the expected number, and then the transport container classified as incorrectly filled is directed onto a conveyor receiving transport containers classified by the control unit as incorrectly filled containers.

The introduction of the counting module in the filling apparatus allows controlling in real time the number of rods put into the transport containers with a considerably greater accuracy compared to the statistical methods, known from the prior art, for determining the number of rods in the container. The solution according to the invention is based on the counting of individual rod-like articles actually being in the transport container, which allows avoiding the uncertainty occurring in conventional methods, and resulting from the adopted methodology using a number of assumptions of geometric nature related to the size of the transport container, or concerning physical parameters of the rod-like articles such as their shape, dimensions, compressibility, and susceptibility to deformation.

Moreover, the method and the apparatus according to the invention solve a technical problem which could not be solved by the known statistical methods, the method and the apparatus according to the invention take into account in the rod counting process any irregularities of arrangement of the rod-like articles in the container which occur in the process of filling the transport container with the rod-like articles. The irregularities of arrangement of the rod-like articles appear in the filling process due to the occurrence of friction among individual rod-like articles, the elasticity of the rod-like articles occurring during the mechanical interaction with other rod-like articles as well as the actuating elements of the filling unit and the store walls or the transport container walls. In addition, the arrangement of the rod-like articles in the container is influenced by environmental factors such as the air humidity and the presence of electrostatic charges.

The object of the invention was shown in detail in a preferred embodiment in a drawing in which.

Figure 1:
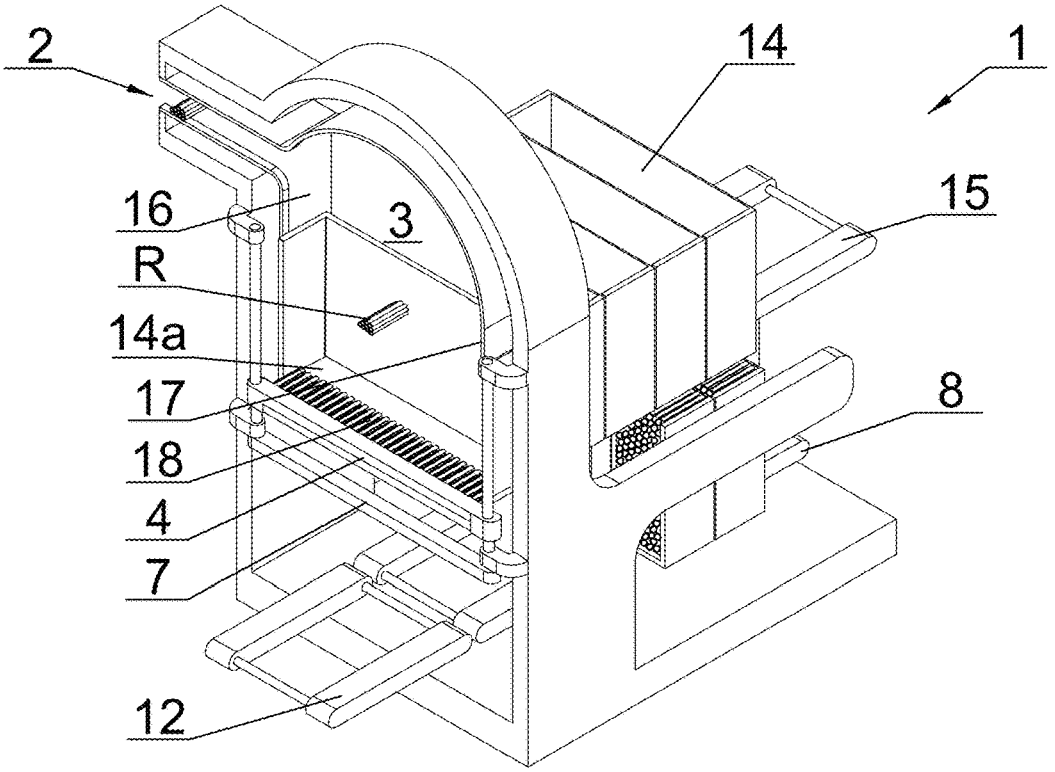
FIG. 1 shows an apparatus according to the invention in a first embodiment.

FIG. 1 shows a first embodiment of the invention in the form of an apparatus (1) for filling transport containers (14) with rod-like articles (R) of the tobacco industry. The apparatus according to the invention is provided with an area (2) receiving the rod-like articles in the form of mass flow, a rod-like article storage area (3) comprising at least two sidewalls (16, 17), a filling unit (4) constituting the bottom wall of the storage area (3) for transferring the rod-like articles (R) from the storage area (3) to the transport container (14). The apparatus (1) is further provided with a module (6) (shown in FIGS. 10-14) for counting of the rod-like articles (R) in the transport containers (14), adapted so that it counts the individual rod-like articles (R) located in the transport container (14).

The apparatus (1) according to the first embodiment of the invention comprises the module (6) (shown in FIGS. 10-14) for counting of the rod-like articles (R) provided with a sensor (7) selected from a group comprising electromagnetic radiation sensors, including infrared sensors, sensors working in the visible light range, and sensors working in the ultraviolet light and x-ray radiation range or other sensors creating an image showing individual rod-like articles (R) in the transport container (14), and the counting takes place by analysing the image of the front surface of the rod-like articles (R) coming from the sensor (7). For this purpose, the counting module (6) was provided with a counting system (26) (shown in FIGS. 10-14) for counting of the rod-like articles (R) in the transport container (14) based on the image of front surface of the rod-like articles (R) from the sensor (7). The counting system (26) is a system comprising for example classic artificial neural networks, convolutional neural networks or any other image analysis system known from the prior art, capable of identifying the rod-like articles in the image from the sensor (7).

Empty transport containers (14) are delivered manually or automatically onto an empty container conveyor (15) from where they are conveyed towards the storage area (3) for the rod-like articles (R). After inserting the bottom wall of the transport container (14) into the area of the filling unit (4) just beneath its working elements (18), the container (14) filling process is started by bringing the working elements (18) of the filling unit (4) into oscillating motion allowing the rod-like articles (R) to pour through from the storage area (3) to the transport container (14).

The working elements (18) of the filing unit (4) are controlled depending on the needs so as to fill the transport container (14) with the rod-like articles (R). During the transport container (14) filling process it is lowered down by means of a lowering conveyor (5) (shown in FIGS. 10-14) with a speed corresponding to the speed of the rod-like articles (R) pouring through the working elements (18) of the filling unit (4).

Figure 2:
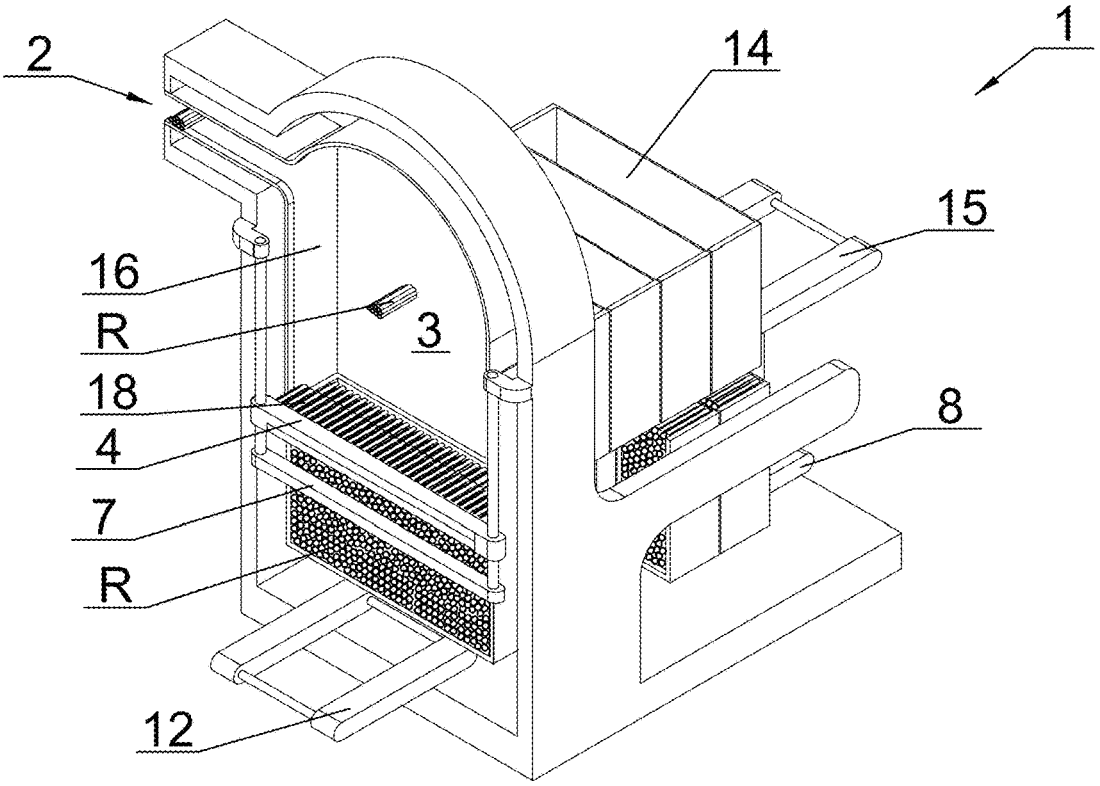
FIG. 2 shows an apparatus according to the invention in a second embodiment.

In this embodiment of the invention, the module (6) for counting of rod-like articles (R) acquires the image showing the rod-like articles (R) in the transport container (14) situated directly beneath the filling unit (4), i.e. the bottom wall of the storage area (3). The sensor (7) of the counting module (6) is situated in the area of the filling unit (4) so that the field of operation of the sensor (7) allows creating an image showing the front surface of the rod-like articles (R) in the area of the filling unit (4), which was shown in FIG. 2.

When lowering the transport container (14) down, the sensor (7), in this embodiment in the form of a linear sensor permanently mounted on the structure of the apparatus (1), is recording the image of front surface of the rod-like articles (R) being in the transport container (14) which is then transferred to the counting system (26).(FIGS. 10-14)

After the end of the filling process, the correctly filled container (14) is transported by means of a receiving conveyor (8) in the container (14) transport direction (T).

Figure 3:
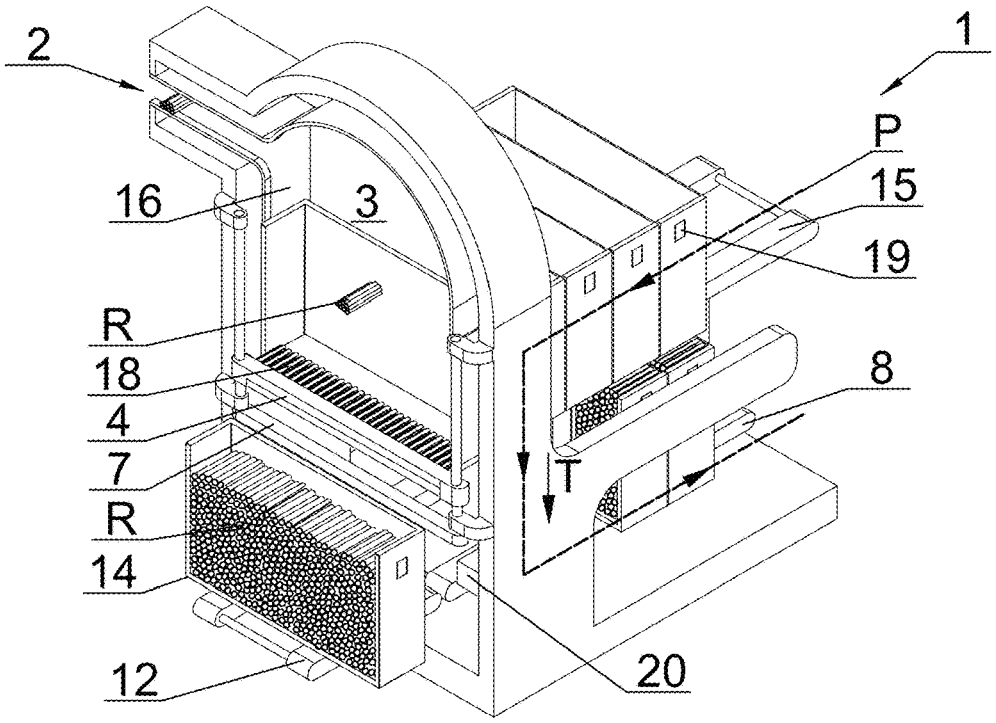
FIG. 3 shows an apparatus according to the invention in a third embodiment.

FIG. 3 shows the apparatus (1) for filling the transport containers (14) with the rod-like articles (R) with the sensor (7) permanently mounted on the structure of the apparatus (1), situated beneath the filling unit (4) when looking in the direction (T), down the container (14) transport path (P). In this embodiment of the invention, the apparatus (1) further comprises a conveyor (12) receiving the transport containers which have been incorrectly filled. Once the number of the rod-like articles (R) being in the container (14) has been counted by the counting module (6) (not shown in FIG. 3), and based on the signal from the counting module (6) the control unit (11) generates a signal classifying the filled transport containers (14) as correctly filled containers which are directed onto the receiving conveyor (8) and incorrectly filled containers which are directed onto the receiving conveyor (12).

The conveyors are used in the filling apparatuses for the purpose of automation of the filling process.

The apparatus (1) for filling the transport containers (14) with the rod-like articles (R) may be provided with a sensor (20) of identification tags (19) of the containers (14) and link the information about the number of counted rod-like articles (R) with the information identifying the respective transport container (14). Such aggregated information is used to control the transport container (14) filling and transport process. For example the aggregated information containing the identification data of the container (14) and the number of the rod-like articles (R) placed into it may be used to direct the containers (14) containing less rod-like articles (R) than the assumed limiting number of the articles (R) to an appropriate transport branch in the transport system in which the container filling apparatus operates, in particular other than the transport branch to which the containers (14) containing more rod-like articles (R) than the assumed limiting number of the articles (R) are directed.

As the identification tag (19) may be used for example a RFID tag placed on the transport container (14) or a printed label stuck on the container (14), containing details of the quantity and kind of rod-like articles situated in this container or the barcode only. The container (14) provided with such tag, after filling and counting, by the counting module (6), the quantity of rod-like articles (R) being in this container, is transported in the area of operation of the sensor of the identification tags (20) where the information is assigned to the specific container or a label containing such information is affixed.

Figure 4:
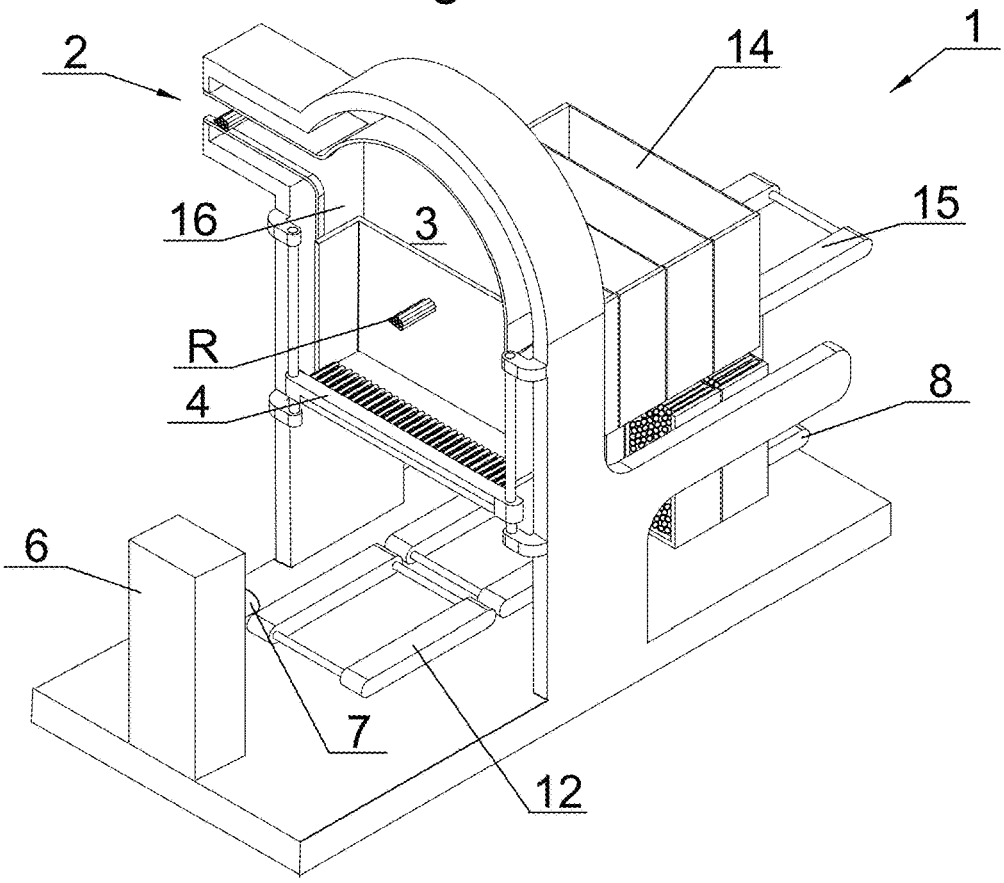
FIG. 4 shows an apparatus according to the invention in another embodiment.

FIG. 4 shows the apparatus (1) for filling the transport containers (14) with the rod-like articles (R). In this embodiment, the apparatus (1) is provided with a stationary sensor (7) of the counting module (6) which is situated at the front of the filling unit (4) so that the image of the filled container (14) can be recorded in order to count the number of rod-like articles contained therein. The counting module (6) in such form may be moved to another place on the apparatus (1) where it will be possible to count the rod-like articles in the container (14). The counting module (6) may also be a free-standing module put next to the apparatus (1) at a place where it will be possible to record the image of the filled container with the sensor (7). Even though the counting module (6) will not be permanently attached to the apparatus (1), it will be connected by a wire or wireless (for example through wireless networks such as Bluetooth or Wi-Fi) with the control unit (11) and/or the apparatus (1) in order to transmit the information or the signal of the number of counted rod-like articles (R) being in the container and/or the return signal to the unit adjusting the filling level (10) in the containers (14), which was shown in further figures.

Figure 5:
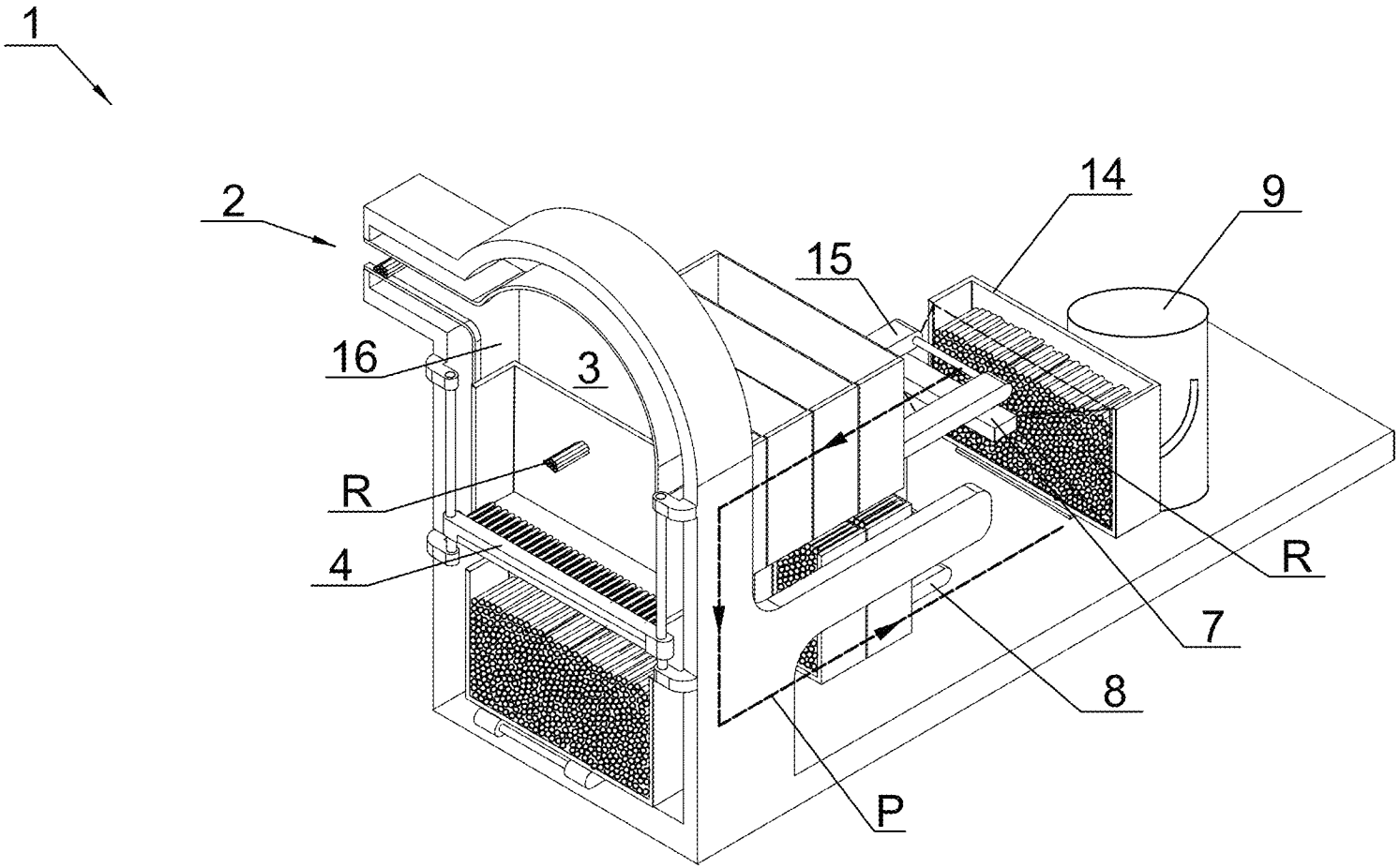
FIG. 5 shows an apparatus according to the invention in another embodiment.

FIG. 5 shows the apparatus (1) in the embodiment with a lifting conveyor (9) situated at the end of the container (14) transport path (P) on the apparatus (1).

The transport container (14), after filling with the rod-like articles (R) by the filling unit (4), is transported by the receiving conveyor (8) along the path (P) at the end of which it is transferred onto the lifting conveyor (9). When the transport container (14) is already on the conveyor (9), by means of the sensor (7) the image of the front surface of rod-like articles (R) being in the transport container (14) is recorded. The sensor (7) in this embodiment was situated beneath the conveyor of empty containers (15). A different place of installation of the sensor (7), for example in the area of the receiving conveyor (8), is also possible.

The lifting conveyor (9), by making a rotational ascending motion, lifts the container (14) filled with the rod-like articles (R) to a height which will be convenient for the operator receiving the container (14)

Figure 6:
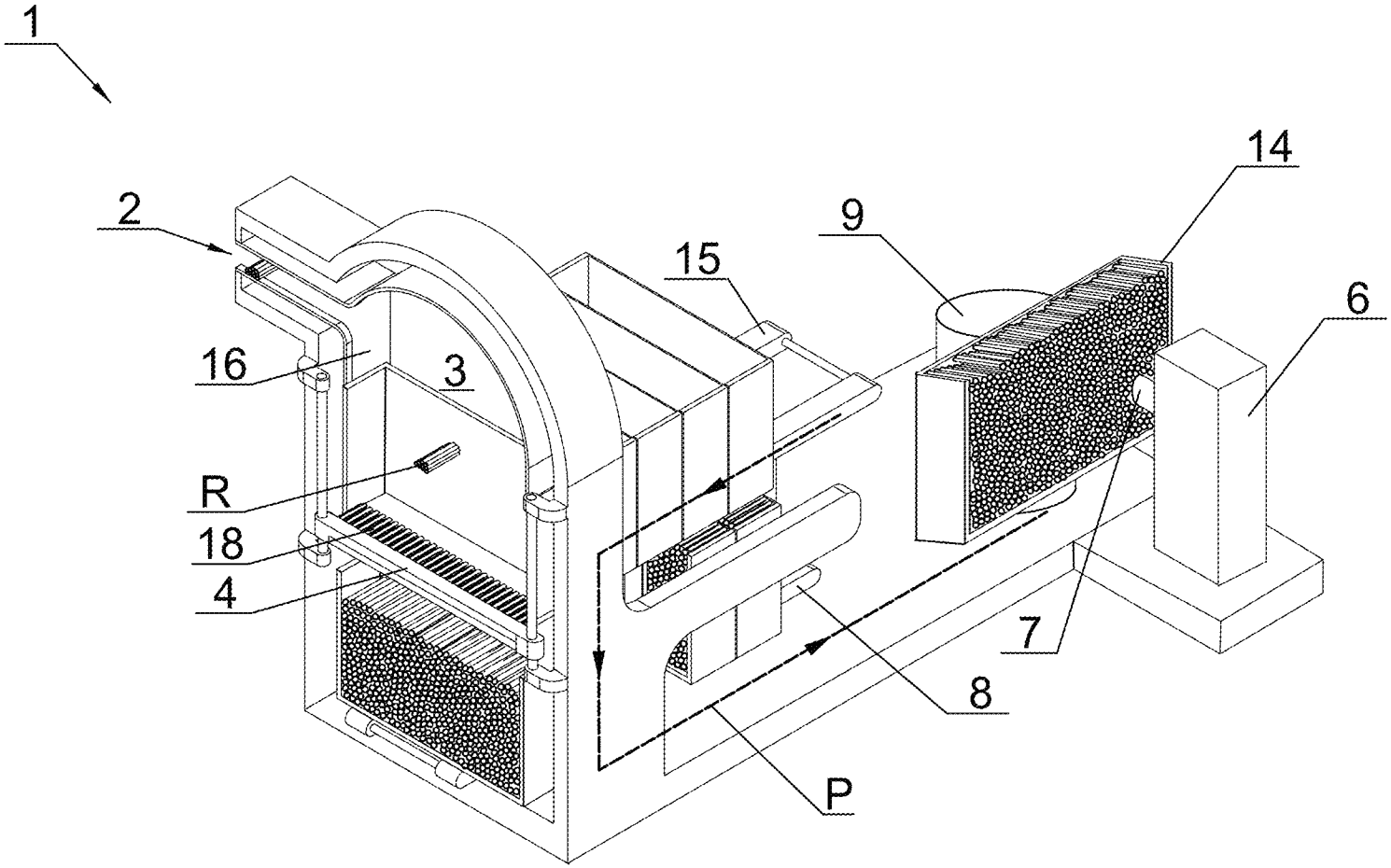
FIG. 6 shows an apparatus according to the invention in another embodiment.

FIG. 6 shows the apparatus (1) for the filling of the containers (14) with the rod-like articles (R) wherein the counting module (6) is situated at the end of the container (14) transport path (P) when looking down from the filling unit (4). In this embodiment, the front surface of the rod-like articles (R) being in the container (14) may be recorded at the moment of turning and/or lifting of the container (14) on the lifting conveyor (9). After the counting, the lifting conveyor (9) may make a further turn, for example by 90 degrees, in order to facilitate the operator's access to the container (14) situated on the conveyor (9).

Figure 7:
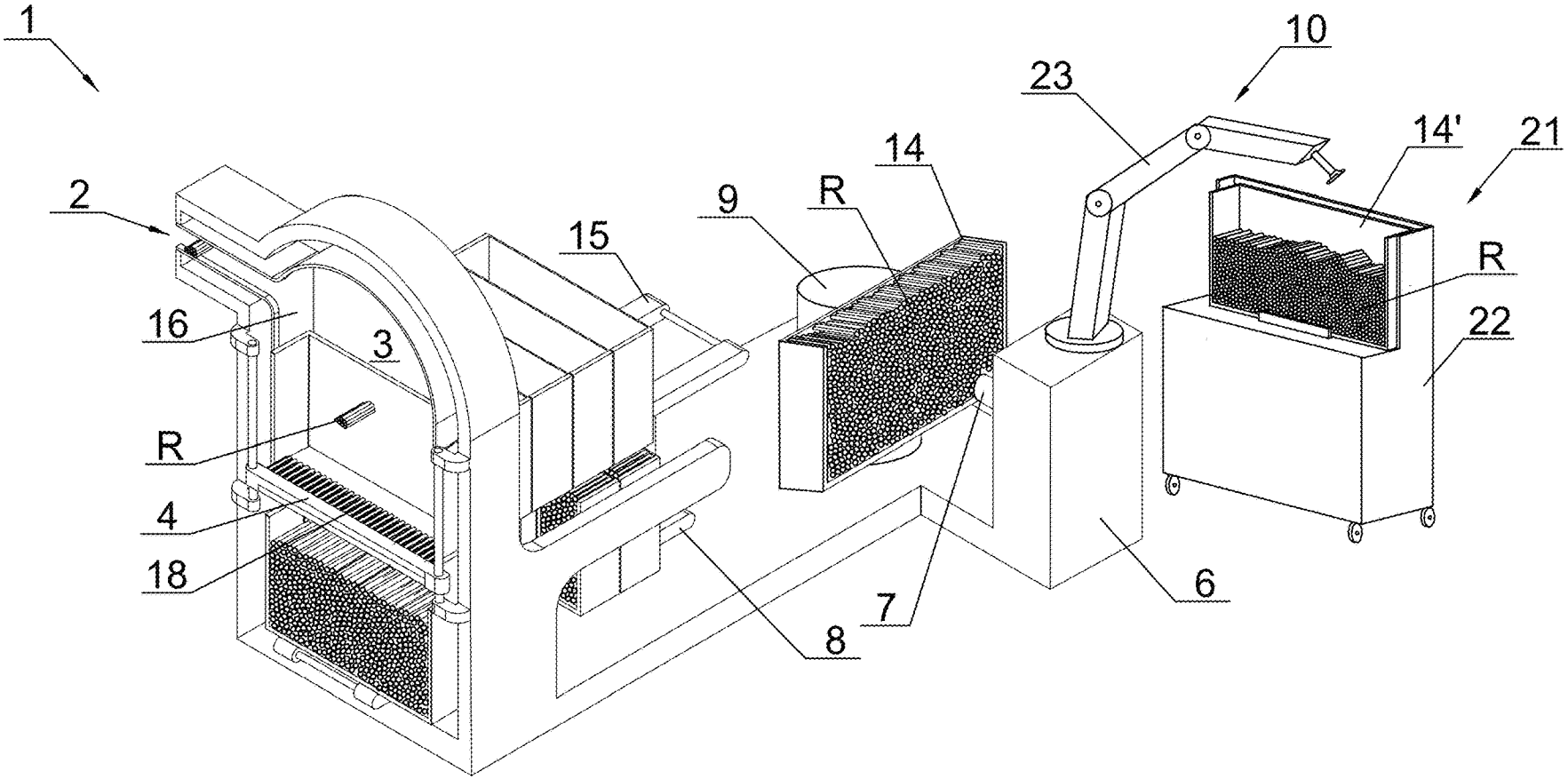
FIG. 7 shows an apparatus according to the invention in another embodiment.

FIG. 7 shows the apparatus (1) provided with a unit adjusting the level (10) of container (14) filling with the rod-like articles (R). After counting the number of the rod-like articles (R) being in the container (14) by the counting module (6), the result is compared by the control unit (26) (not shown in FIG. 7) with a desired value representing the expected number of the rod-like articles (R) which should be in the container (14) once it has been filled. If the result differs from the desired value, the control unit (11) sends a signal (13) (shown in FIGS. 10-14) to the unit adjusting the filling level (10) which adjusts the filling level of the container (14) to the desired value. The unit adjusting the filling level (10) may be, like in this embodiment, a manipulator (23) which, in case the number of the rod-like articles (R) in the container (14) is smaller than the assumed limiting number of the rod-like articles (R) in the container (14), takes a number of rod-like articles (R) from the storage container (21) corresponding to the number missing in the container (14). In this embodiment, a container (14') placed on a trolley (22) was used as the storage container (21) for the rod-like articles (R).

If the number of rod-like articles (R) in the container (14) is greater than the desired value representing the expected number of rod-like articles (R) in the container (14), the unit adjusting the filling level (10) takes from the container (14) a number of rod-like articles (R) corresponding to the number of rod-like articles (R) in the container (14) by which the desired quantity of rod-like articles (R) is exceeded. The rod-like articles (R) taken are put into the storage container (21). After the end of the filling level adjustment process, there is the desired quantity of rod-like articles (R) in the container (14).

Figure 8:
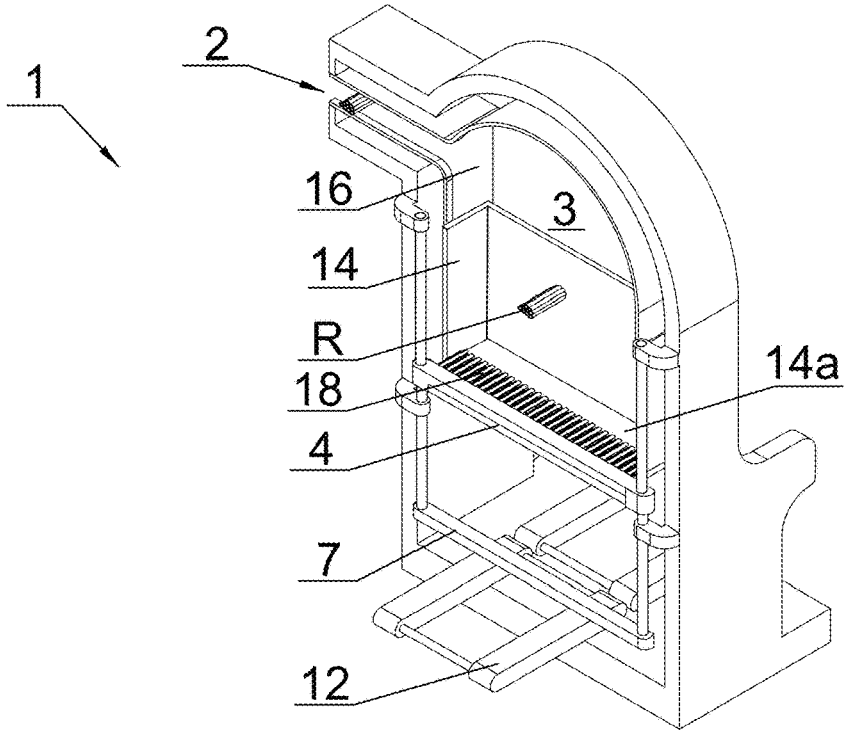
FIG. 8 shows an apparatus according to the invention in another embodiment.
Figure 9:
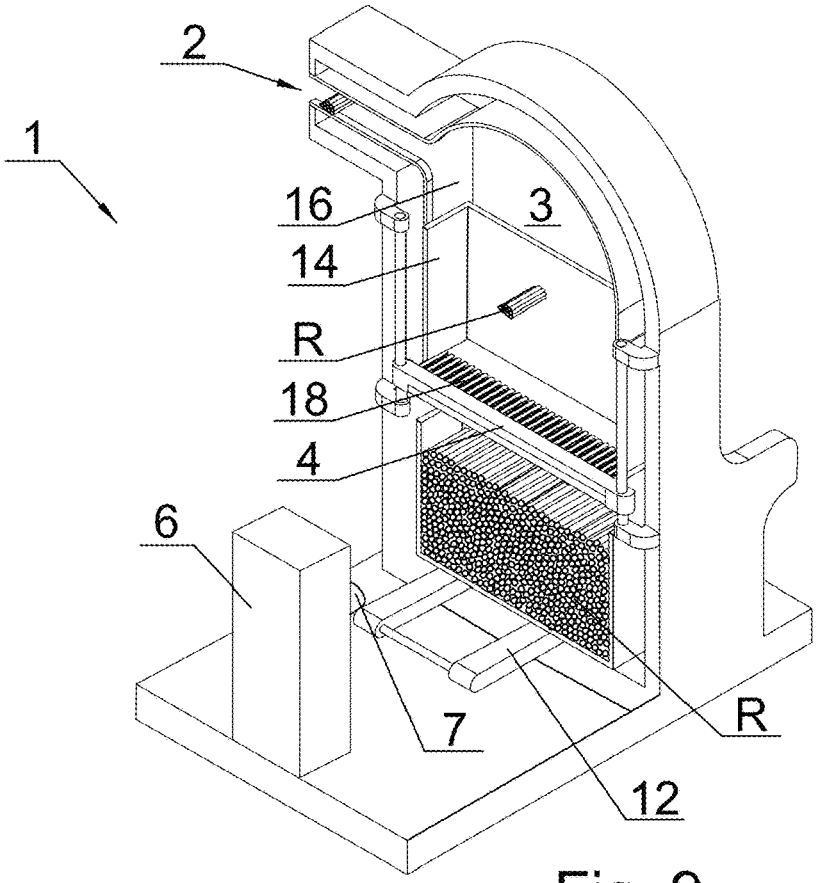
FIG. 9 shows an apparatus according to the invention in another embodiment.

FIGS. 8 and 9 show another embodiment of the apparatus 1 wherein the apparatus (1) for the filling of the containers (14) is adapted to manual placing of the transport containers (14) in the filling apparatus (1), and to manual receiving of the containers (14) from the filling apparatus (1). Empty transport containers (14) are delivered manually by the operator to the container (14) filling apparatus (1) shown in FIG. 8 into the area of the filling unit (4). After inserting the bottom wall (14*a*) of the transport container (14) into the area of the filling unit (4) just beneath its working elements (18), the container (14) filling process is started by bringing the working elements (18) of the filling unit (4) into oscillating motion allowing the rod-like articles (R) to pour through from the storage area (3) to the transport container (14).

The working elements (18) of the filling unit (4) are controlled depending on the needs so as to fill the transport container (14) with the rod-like articles (R). In the case of the apparatus shown in FIG. 8, in the course of filling of the transport container (14) it is lowered down by means of the lowering conveyor (5) (shown in FIG. 10-14) with a speed corresponding to the speed of the rod-like articles (R) pouring through the work elements (18) of the filling unit (4). In this embodiment, the image of the front surface of the rod-like articles (R) being in the container (14) is recorded by means of the sensor (7) of the counting module (6) mounted movably relative to the structure of the apparatus (1) after the end of the container (14) filling process. In FIG. 9, the image may be also recorded just after filling the container (14). Based on the recorded image and the specially selected algorithms, the quantity of the rod-like articles (R) being in the container (14) is counted. If the number of the articles (R) being in the container (14) does not correspond to the desired number of articles which should be therein, the container (14) is transferred onto the receiving conveyor (12) and delivered to be picked up by the operator, for example for the purpose of manual adjustment of the container (14) filling level. If the quantity of the articles (R) being in the container (14) corresponds to the desired quantity, the filled container (14) is received by the operator on the side of the apparatus (1) situated opposite to the side where incorrectly filled containers are received.

Figure 12:
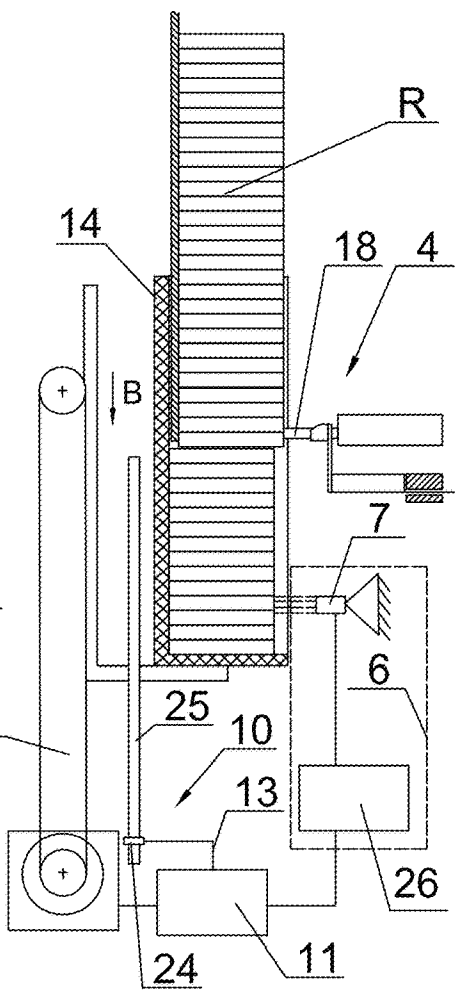
FIGS. 10-12 show an apparatus according to the invention in another embodiment.
Figure 11:
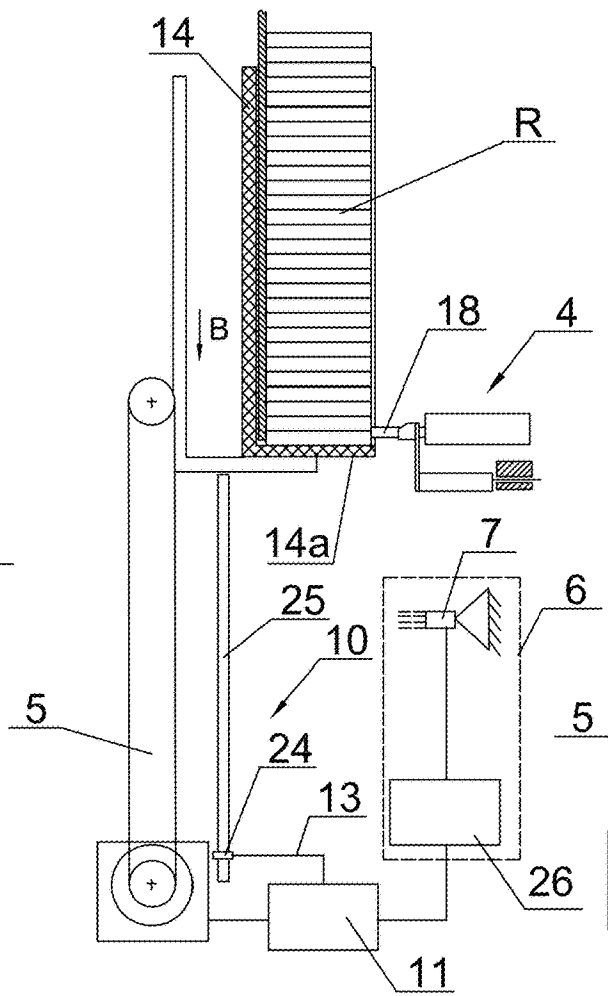
Figure 10:
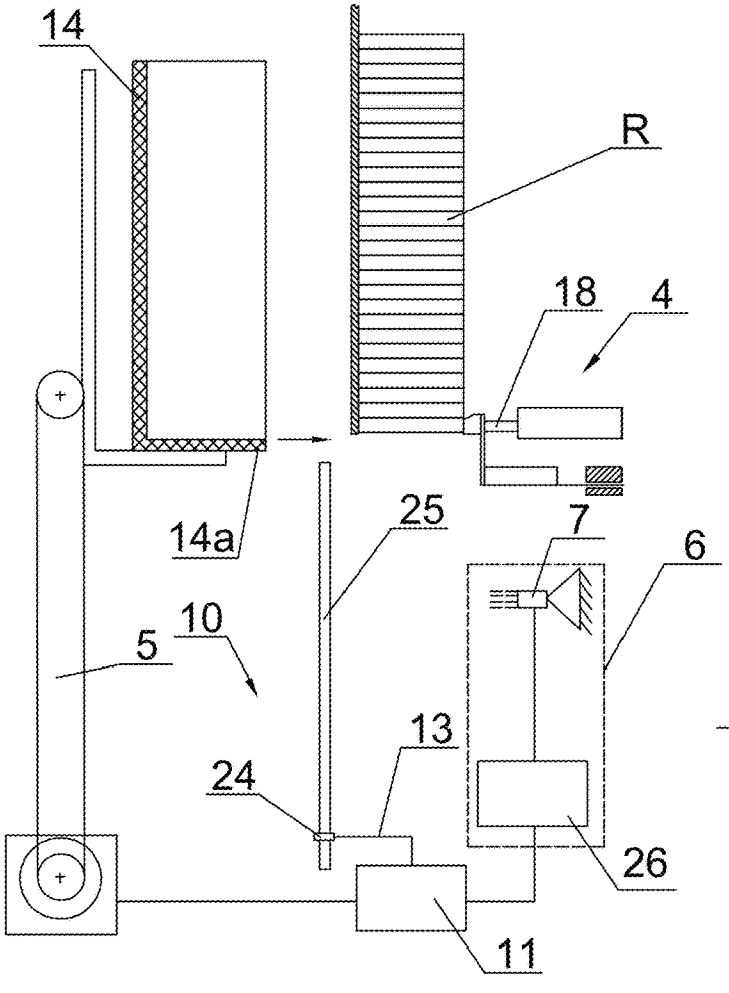

FIGS. 10-12 show further methods of recording the image of the front surface of the rod-like articles (R) being in the transport container (14). After inserting the bottom wall (14*a*) of the transport container (14) into the area of the filling unit (4) just beneath its working elements (18) (FIG. 11), the container (14) filling process is started by bringing the working elements (18) of the filling unit (4) into oscillating motion allowing the rod-like articles (R) to pour through from the storage area (3) to the transport container (14). During the filling process, the container (14) is lowered in the direction (B) downwards, by means of the lowering conveyor (5) with a speed corresponding to the speed of rod-like articles (R) pouring through the working elements (18) of the filling unit (4). During the container (14) lowering by means of the sensor (7) of the counting module (6), the image of the front surface of the rod-like articles (R) being already in the container (14) is recorded. The sensor (7) in this embodiment is permanently mounted on the structure of the apparatus. Once the image has been recorded by the sensor (7), the image of the front surface of the rod-like articles (R) being in the container (14) is processed and the articles (R) are counted by the counting system (26) of the counting module (6). Based on the received result, the control unit (11) classifies the containers as correctly and incorrectly filled and sends a signal (13) to the unit adjusting the filling level (10) of the container (14). In addition, the control unit (11), based on the received message of the quantity of rods being in the container from the counting module (6), controls the conveyor receiving filled containers (8) and the conveyor receiving incorrectly filled containers (12). In this embodiment, the unit adjusting the level (10) of container (14) filling with the articles (R) has the form of a filling sensor (24) situated on a straight edge (25) along which the container (14) is lowered during the filling by means of the lowering conveyor (5).

Figure 13:
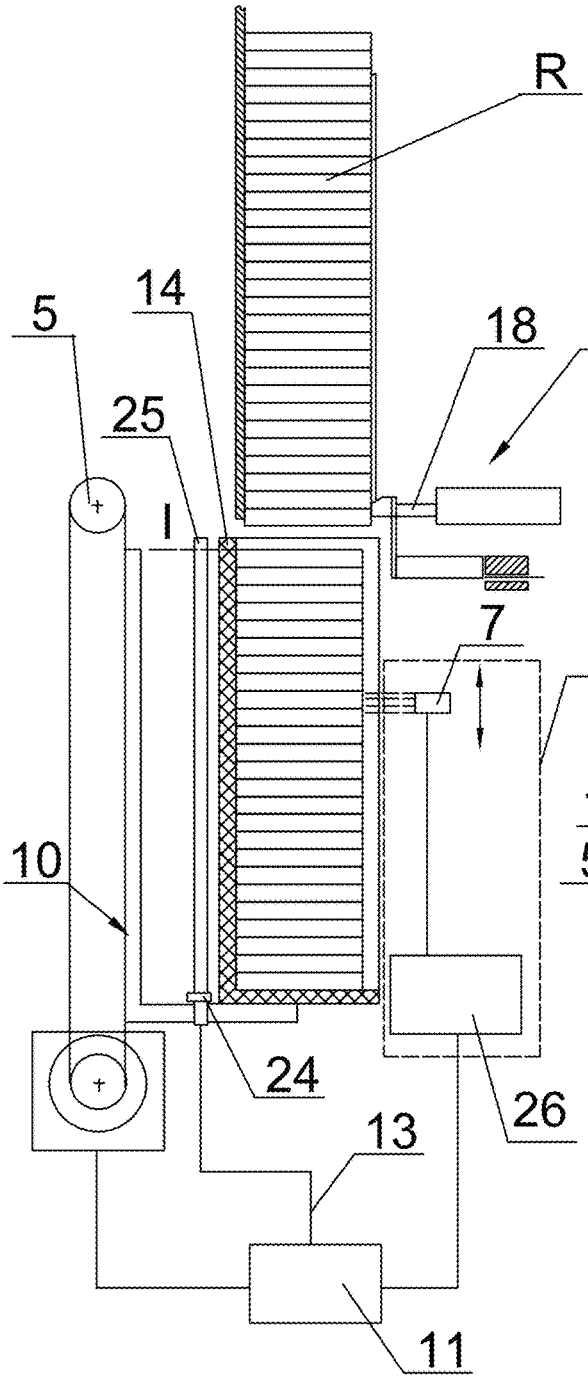
FIGS. 13-14 show an apparatus according to the invention in another embodiment.
Figure 14:
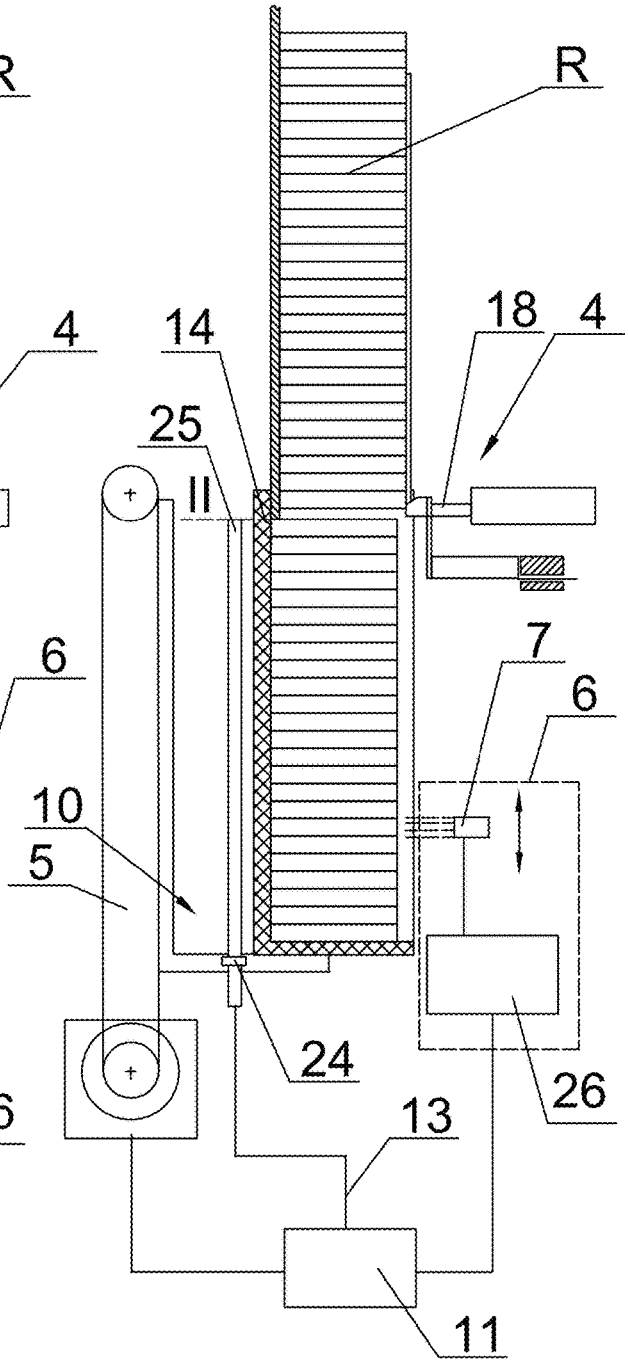

FIG. 13 shows an example of filling of the transport container (14) with the rod-like articles (R) to the level I marked in FIG. 13 with a dashed line. After the filling of the container (14), the working elements (18) of the filling unit (4) are stopped and the image of the front surface of the rod-like articles (R) being in the container (14) is recorded by means of the sensor (7), in this embodiment mounted movably relative to the structure of the apparatus (1). After processing the received image and counting the number of the rod-like articles (R) being in the container (14) by the counting system (26) of the counting module (6), a signal representing the number of the rod-like articles (R) in the transport container (14) is transmitted to the control unit (11); based on this signal, the control unit (11) sends a signal (13) to the unit adjusting the container (14) filling level (10). The unit adjusting the filling level (10), after receiving the signal (13) of excessive number of the articles (R) being in the container (14) compared to the desired value, changes the settings of the filling sensor (24) in the straight edge (25), which was shown in FIG. 14. The settings of the filling sensor (24) are changed by a value corresponding to the difference between the quantity of the rod-like articles being in the container (14) and the desired value so that during the filling of the next container (14) the quantity of the articles (R) being in the container (14) corresponds to the desired value which, in this example, corresponds to the level II marked in the figure with a dashed line.

The invention claimed is:

1. An apparatus (1) for filling transport containers (14) with rod-like articles of the tobacco industry, provided with an area (2) receiving the rod-like articles in the form of a mass flow, a rod-like article storage area (3) comprising at least two sidewalls, a filling unit (4) constituting a bottom wall of the storage area for transferring the rod-like articles from the storage area (3) to the transport container (14), a lowering conveyor (5) working together with the filling unit (4), adapted to lower the transport container (14) while filling with the rod-like articles, characterised by being further provided with a counting module (6) designed to count the rod-like articles in the transport containers (14), adapted so that individual rod-like articles located in the transport container (14) are counted, before a receiving conveyor (8, 12) receives the transport container (14) filled with the rod-like articles.

2. The apparatus according to claim 1 wherein the filled transport containers (14) have a transport path, and wherein the counting module (6) comprises a sensor (7) designed to receive an image of the rod-like articles in the transport container (14), such sensor (7) being situated in the filling apparatus (1) in the transport path of transport containers (14) being filled with the rod-like articles, below the filling unit (4), and wherein a counting system (26) is designed to count the rod-like articles in the transport container (14) based on the image from the sensor (7).

3. The apparatus according to claim 1 wherein a transport chain comprises an area of the filling unit (4), the lowering conveyor (5), a conveyor (8) receiving the filled transport containers (14) being filled with the rod-like articles, a conveyor (9) lifting the filled transport containers (14) filled with rod-like articles.

4. The apparatus according to claim 2 wherein the sensor (7) is permanently mounted on the structure of the apparatus, and the transport container (14) filled with the rod-like articles during the measurement remains immovable in front of the sensor (7).

5. The apparatus according to claim 2, the apparatus having a structure, wherein the sensor (7) is permanently mounted on the structure of the apparatus, while the transport container (14) filled with the rod-like articles during the measurement moves in front of the sensor (7).

6. The apparatus according to claim 2, the apparatus having a structure, wherein the sensor (7) is mounted movably relative to the structure of the apparatus, while the transport container (14) filled with the rod-like articles during the measurement remains immovable in front of the sensor (7).

7. The apparatus according to claim 2, the apparatus having a structure, wherein the sensor (7) is mounted movably relative to the structure of the apparatus, and, in addition, the transport container (14) filled with the rod-like articles during the measurement moves in front of the sensor (7).

8. The apparatus according to claim 1 wherein the apparatus further has a unit adjusting a level (10) of the transport container (14) filled with the rod-like articles based on the number of rod-like articles determined by the counting module (6).

9. The apparatus according to claim 1 wherein a control unit (11) is adapted to generate a signal classifying the transport containers (14) as correctly filled transport containers and incorrectly filled transport containers based on the number of rod-like articles determined by the counting module (6).

10. The apparatus according to claim 9 wherein the apparatus is further provided with a conveyor (8) receiving the transport containers (14) classified by the control unit (11) as correctly filled containers and a conveyor (12) receiving the transport containers (14) classified by the control unit (11) as incorrectly filled transport containers (14).

11. The apparatus according to claim 1 wherein the counting module (6) counting the rod-like articles comprises a sensor (7) selected from a group comprising electromagnetic radiation sensors, including infrared sensors, sensors working in the visible light range, and sensors working in the ultraviolet light or x-ray radiation range which create an image of individual rod-like articles in the transport container (14), and a counting system (26) determines the number of rod-like articles by analysing the image coming from the sensor (7).

* * * * *